US010588369B2

(12) United States Patent
Ruppert-Stroescu et al.

(10) Patent No.: US 10,588,369 B2
(45) Date of Patent: Mar. 17, 2020

(54) TEXTILE REPURPOSING AND SUSTAINABLE GARMENT DESIGN

(71) Applicant: The Board of Regents for Oklahoma State University, Stillwater, OK (US)

(72) Inventors: Mary Susan Ruppert-Stroescu, St. Louis, MO (US); Elizabeth Schrantz, Oklahoma City, OK (US); Carissa Elizabeth Gabilheri, Stillwater, OK (US); Lynae Jonice Dowdell, Oklahoma City, OK (US)

(73) Assignee: The Board of Regents for Oklahoma State University, Stillwater, OK (US)

( * ) Notice: Subject to any disclaimer, the term of this patent is extended or adjusted under 35 U.S.C. 154(b) by 331 days.

(21) Appl. No.: 15/790,480

(22) Filed: Oct. 23, 2017

(65) Prior Publication Data

US 2018/0125139 A1 May 10, 2018

Related U.S. Application Data

(60) Provisional application No. 62/411,229, filed on Oct. 21, 2016.

(51) Int. Cl.
*A41H 3/06* (2006.01)
*A41D 31/00* (2019.01)
(Continued)

(52) U.S. Cl.
CPC ..... *A41H 3/06* (2013.01); *A41D 31/0005* (2013.01); *A41H 42/00* (2013.01); *A41H 43/04* (2013.01);
(Continued)

(58) Field of Classification Search
CPC ..... A41H 3/06; A41H 42/00; A41H 43/0207; A41H 43/04; D05B 5/00; D05B 95/00; D05B 95/04; D05B 97/12
See application file for complete search history.

(56) References Cited

U.S. PATENT DOCUMENTS 4,300,267 A * 11/1981 Winch ..... D01G 9/00 19/107
4,646,666 A * 3/1987 Burrier ..... D05B 97/12 112/420
(Continued)

FOREIGN PATENT DOCUMENTS

WO WO2011068399 A1 6/2011
WO WO2011077446 A1 6/2011

*Primary Examiner* — Danny Worrell
(74) *Attorney, Agent, or Firm* — Crowe & Dunlevy; Terry L. Watt

(57) ABSTRACT

This disclosure addresses a problem in relation to the environmental destruction that excessive apparel production can produce. In various embodiments, existing textile products are deconstructed into pieces of fabric and then reassembled into apparel in a manner that creates minimal or zero waste. In some embodiments, the fabric pieces will be positioned inside of one or more pattern pieces so as to completely cover each one without overlapping its border. The positioned pieces will be treated with an adhesive and then have a paper layer adhered to it to hold the positioned fabric pieces in place while they are stitched together. Then, the resulting sandwich will be soaked to remove the paper and dissolve the adhesive. The resulting unified fabric component will then be available to be stitched together with other similarly formed fabric components to form a garment.

13 Claims, 5 Drawing Sheets

(51) Int. Cl.

| | |
|---|---|
| ***A41H 43/04*** | (2006.01) |
| ***D04H 1/4274*** | (2012.01) |
| ***A41H 42/00*** | (2006.01) |
| *D05B 5/00* | (2006.01) |
| *A41H 27/00* | (2006.01) |

(52) U.S. Cl.
CPC ..... *D04H 1/4274* (2013.01); *A41H 27/00* (2013.01); *D05B 5/00* (2013.01); *D05D 2305/30* (2013.01); *D10B 2403/01* (2013.01); *D10B 2403/03* (2013.01)

(56) References Cited

U.S. PATENT DOCUMENTS 5,481,864 A * 1/1996 Wright ..... D01G 9/14 19/107
5,671,495 A * 9/1997 Chen ..... A43B 13/02 12/142 G
5,778,492 A * 7/1998 Thiessen ..... D01G 13/00 19/107
5,912,062 A * 6/1999 Kotliar ..... B32B 5/26 156/276
6,147,128 A * 11/2000 Reither ..... C08J 11/06 521/48
6,378,179 B1 * 4/2002 Hirsch ..... D04H 1/4274 19/107
6,637,085 B2 * 10/2003 Chi ..... D01G 11/04 19/107
10,046,551 B1 * 8/2018 Wei ..... A43B 1/0063
10,316,467 B2 * 6/2019 Weilach ..... D01F 2/06
2005/0080520 A1 * 4/2005 Kline ..... B03B 9/06 701/1
2007/0083970 A1 * 4/2007 Turney ..... A41B 13/00 2/69
2008/0299853 A1 * 12/2008 Nethers, II ..... B29B 17/0042 442/59
2008/0307556 A1 * 12/2008 Turney ..... A41B 13/00 2/75
2012/0298025 A1 * 11/2012 Kaufmann ..... B32B 27/12 112/400
2013/0065989 A1 * 3/2013 Binder ..... B29B 17/0042 524/18
2013/0330992 A1 * 12/2013 Mitchell ..... D06P 1/22 442/184
2014/0250562 A1 * 9/2014 Matthies ..... F41H 3/02 2/69
2017/0157825 A1 * 6/2017 Weber ..... B29B 17/0026
2018/0125139 A1 * 5/2018 Ruppert-Stroescu .... A41H 3/06
2018/0305847 A1 * 10/2018 Wen ..... D03D 15/0077
2019/0339688 A1 * 11/2019 Cella ..... H04B 17/309

* cited by examiner

*Fig. 2A (sample 001)*
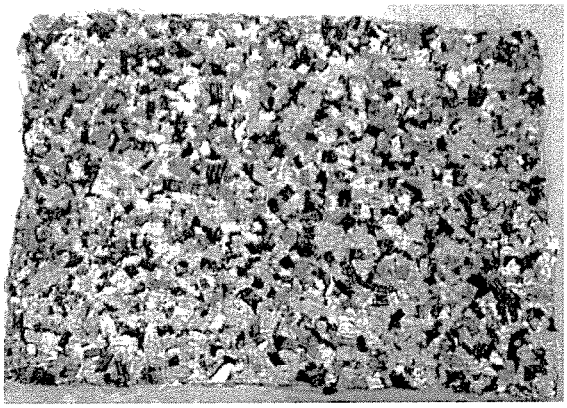
*Fig. 2B (sample 002)*
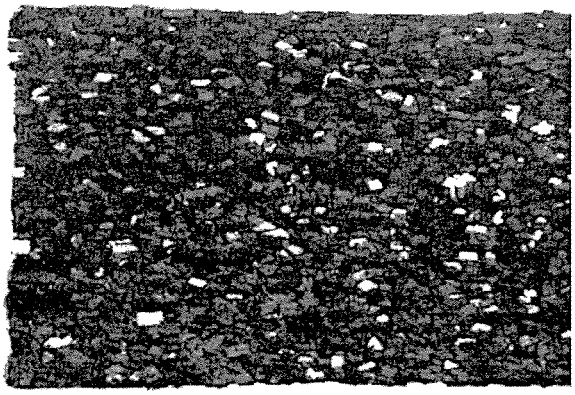
*Fig. 2C (sample 003)*
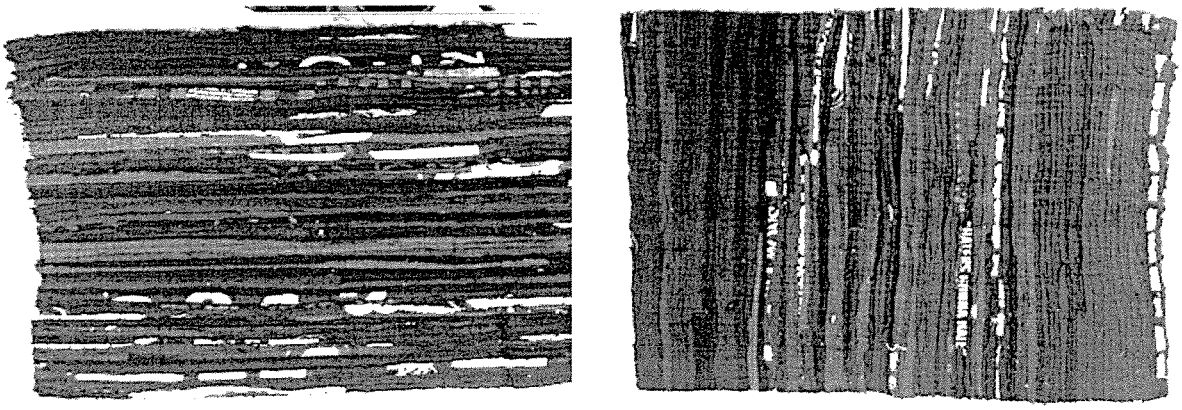
*Fig. 2D (sample 004)*
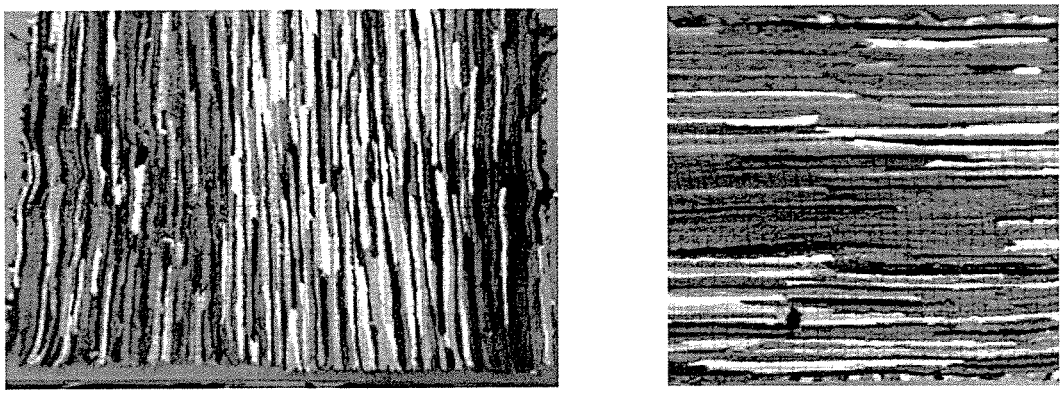

*Fig. 5*
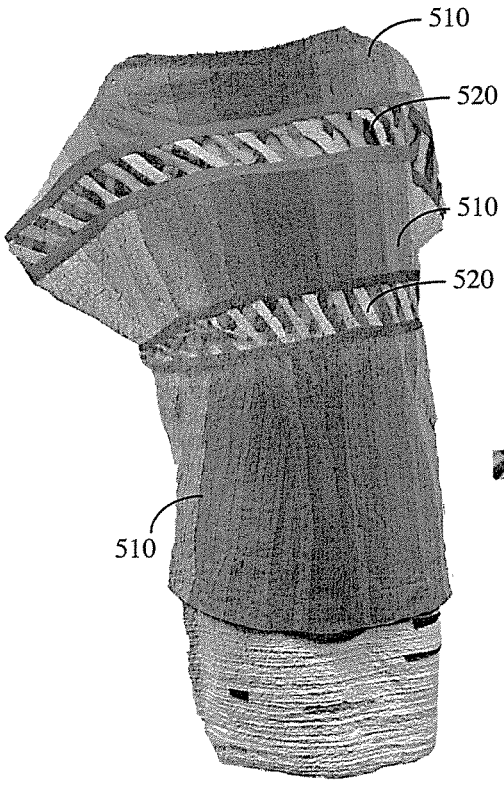
*Fig. 6*
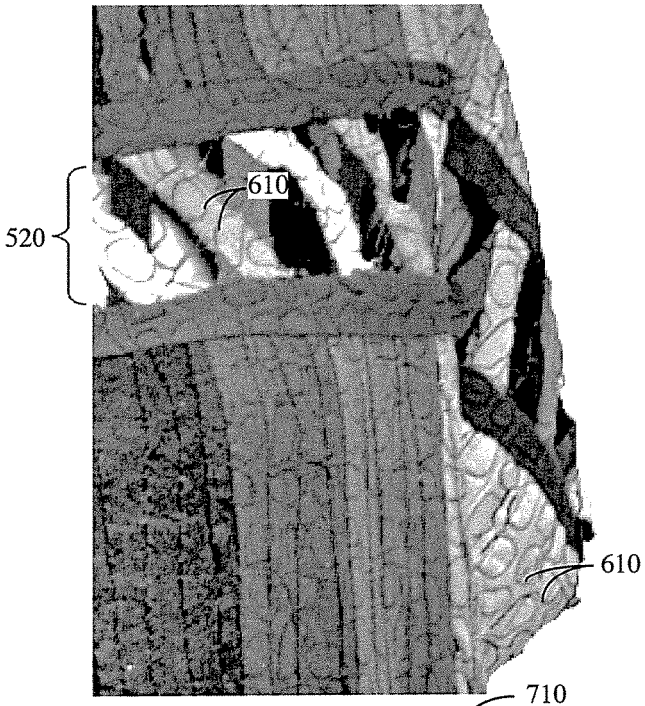
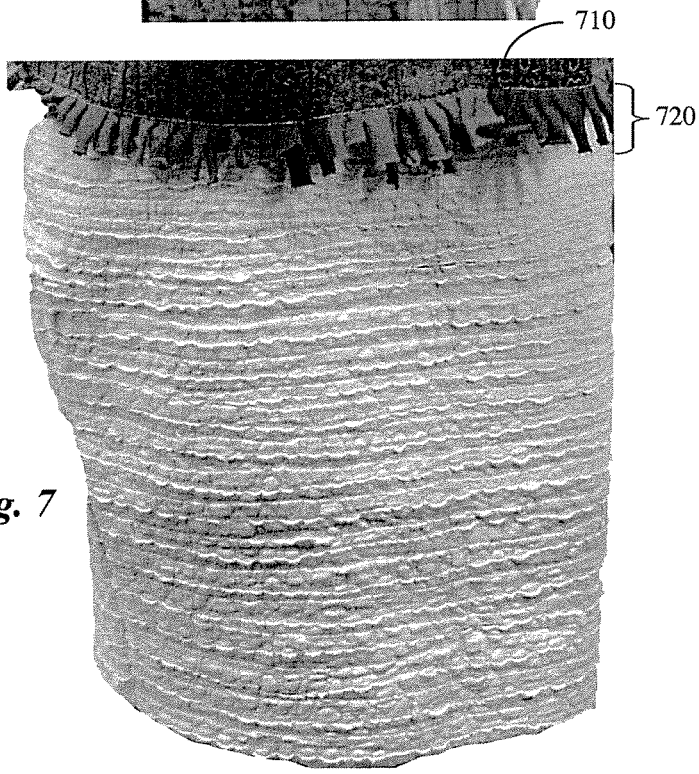
*Fig. 7*

TEXTILE REPURPOSING AND SUSTAINABLE GARMENT DESIGN

CROSS REFERENCE TO RELATED APPLICATIONS

This application claims the benefit of U.S. Provisional Patent Application Ser. No. 62/411,229 filed on Oct. 21, 2016, and incorporates said provisional application by reference into this document as if fully set out at this point.

TECHNICAL FIELD

This disclosure relates generally to a method that repurposes fabric by breaking down existing products and reassembling them in a unique manner and, more particularly, to upcycling used clothing to create new products.

BACKGROUND

Research has been ongoing with regards to developing new technology for the successful deconstruction of used clothing that leads to the creation of new products. The concept of upcycling, or turning something old into a product of the same or greater value, has been gaining increased interest recently. Sustainable textile research began with a desire to change the current wasteful state of the apparel and textile industry. The Environmental Protection Agency (EPA) has estimated that the United States generated 24.5 tons of rubber, leather and textile waste in 2014. Because many fibers do not decompose, they sit in landfills and are hazardous to surrounding life forms, whether they be human or nature. One way of combating this problem begins with recycling, which for the textile and apparel industry means gathering unwanted textiles and extending their useful life.

Upcycling products are defined for purposes of this application to be those that retain "their high quality in a closed-loop industrial cycle". A distinction should be noted regarding the difference between upcycling and recycling. Recycling fully breaks down the textile into fibers again while upcycling still leaves the textile in its fabrication form. There is no uniform upcycling technique, making the reuse of textile products more complex than simply throwing them away or breaking them down.

The apparel and textile industry is constantly growing to meet the demanding needs of consumers. With this growth come large amounts of textile waste as consumers throw away products to make room for new trends which might be fueled by fast fashion. Fast fashion is a phenomenon that has enabled consumers to purchase low cost, trendy clothing. Due to the low cost and high volume, consumers buy frequently which leads them to perceive garments having a short life and to be disposable. In response to these products, the consumer's mindset has created a growing excess of textile waste. Fortunately, people have begun to see the need for upcycling and recycling textiles and clothing and have begun to do so in several ways, including upcycling through garment disassembly, chemical and mechanical process, and salvaging scraps.

Upcycling

Upcycling gives textile products a longer lifecycle which keeps them from entering landfills or overloading developing countries. Consumers have also shown a desire for wearing reused or upcycled clothing, especially if more styles and varieties were available. Upcycling methods are diverse, and include reworking used garments to render them current and desirable, such as repairing, embellishing, or changing the size. Another upcycling method involves turning undesired textiles and/or clothing into fabric by reducing the textiles into smaller particles.

Garment Disassembly

A study recently examined key companies in the United Kingdom that upcycle clothing. The five companies in the study used discarded apparel as a starting and some only used suits or denim. Each of these companies utilized a similar process of research and analysis, concept development, sample preparation, pattern development and cutting, and manufacturing. It is noted that these companies had difficulty reproducing designs exactly and that a mass manufacturing process had not yet been streamlined, only a one-off, niche system of production. An issue for all the companies was the time-consuming labor of disassembling the garments. The solution of this particular study was that new technologies needed to be developed that so that the sorting, grading, and disassembly operations would be standardized. It is implied that the process employed by these companies to create clothing involved separating the garments at the seams and removal of closures and other non-textile materials, then engineering the resulting pieces into garments. No further disassembly appears to have been performed.

Students at Cornell University are using EPA funding to research upcycling clothing. The main focus is developing mass production standards for upcycling clothing, scraps, and threads. While they are making garments from pieces of discarded clothing, they are also developing a machine to "fiberize" the unusable fabric scraps.

One company has several home goods products made from fabric scraps such as leather and silk. Their process is not disclosed, however, the company blog states that they typically weave the scraps of fabric together. Strips of leather are woven together to form clothing by another company.

Scrap Salvaging and Quilting Techniques

As for the longarm quilting machine and use of dissolvable material to create a fabric, no information for an exact process has been found. Variations of the idea are circulating the web as arts and crafts ideas. One artist sews designs onto dissolvable material to create art out of threads. She uses a personal home sewing machine to create her art. An Italian company uses scraps of fabric and threads with clear plastic as the bonding agent rather than dissolvable plastic. An Internet search for dissolvable fabric yields results about reusing scraps and making designs with them by sandwiching them between dissolvable fabric. However, no information has been found on making garments from the dissolvable material and longarm quilting machine and of its scalability.

Recycling

Recycling textiles and clothing by reducing them to fibers seems to be the most common approach for reusing textiles. This can be done either mechanically (cutting, shredding, carding) or chemically (melting, decomposing). Large companies have been successful in these methods and exact processes have been developed whereas upcycling clothing into fabrics has not become as exact.

Mechanical Processing

There is a mechanical process called garnetting that reverses textiles into fiber form. This process has been around for decades and produces a recycled postconsumer fiber. Common applications after this process are paper and insulation or the winding of the garnetted fiber into yarns for weaving. After the garnetting process, the fibers can be made into fabrics or yarns in a variety of ways. Ways include making a nonwoven fiberweb, weaving a yarn from garnetted fiber, and creating a composite fabric. The mechanical process is common in natural fibers such as cotton. Some manufacturers use mechanical processing to break down their scraps made in production. Jean companies have begun to use recycling technologies that breakdown to the fiber form. For example, one jeans manufacturer takes scraps of fabric from manufacturing facilities and breaks them down to make new jeans.

Chemical Processing

A UK based company is developing a chemical-based technology for reclaiming clothing and processing it into new yarns and into clothing, again and again (wornagain-.info). They want to make it commercially scalable and viable. Another approach sorts fabric by fiber content and can do so as fast as one per second. This creates a more efficient and accurate system. It is estimated that in the next few years there will be a large shift in the industry due to recycling technologies.

However, what is needed is a system and method of upcycling clothing that does not suffer the disadvantages of the prior art. In more particular, what is needed is a scalable, economically viable upcycling technique that involves reusing textile products in a way that will help reduce the negative impacts that traditional textile and garment manufacturing has in terms of air and water pollution, energy use, and overall textile waste. This approach should provide a method of upcycling that has less environmental impact and is commercially viable for large scale usage.

Before proceeding to a description of the present invention, however, it should be noted and remembered that the description of the invention which follows, together with the accompanying drawings, should not be construed as limiting the invention to the examples (or embodiments) shown and described. This is so because those skilled in the art to which the invention pertains will be able to devise other forms of this invention within the ambit of the appended claims.

SUMMARY

According to an embodiment, there is provided herein a system and method of deconstructing clothing that results in minimal or even zero waste. One embodiment operates as follows:

Align discarded clothing (discarded t-shirts can be useful in one embodiment) in layers about 5" tall.

Cut the layers into strips (¼" strips can be useful in some embodiments).

Develop garment pattern and trace marker on paper.

Position fabric strips only on the pattern to create textile design. The fabric strips may comprise a single layer, or multiple layers, and may have open spaces between adjacent strips.

Spray the positioned fabric strips with a soluble, preferably water soluble, adhesive.

Place paper on top of the fabric strips, thereby adhering the paper to the fabric.

Mount the fabric "sandwich" on, for example, a sewing machine that allows the fabric sandwich to be held under tension while being sewn using a process that allows for 2-D movement across the sandwich, i.e., both laterally and vertically. The path of the sewing machine might be computer controlled or manual.

Stitch the layers in a systematic pattern with the stitches in some embodiments having a predetermined distance apart (e.g., a maximum of ½" distance) between lines of stitches to form a unified garment or unified garment component.

Place the fabric "sandwich" in water and soak it to remove the paper layer(s) and reveal the pattern piece formed from the fabric.

Block the fabric to the pattern piece shape and dry.

Assemble the garment from the pattern pieces.

Collect the paper from the water.

Reuse paper (e.g., make paper labels from recycled paper).

Current textile recycling methods address decomposing the fibers and turning them back into raw materials. While this approach is commendable, that process requires a great deal of energy and time to transform those recycled raw materials into apparel. Embodiments disclosed herein are different in that they not only utilize existing textiles and break them down so that the style can be transformed to meet contemporary taste, but also include engineering the clothing in a manner that results in minimal or zero waste.

The foregoing has outlined in broad terms some of the more important features of the invention disclosed herein so that the detailed description that follows may be more clearly understood, and so that the contribution of the instant inventors to the art may be better appreciated. The instant invention is not to be limited in its application to the details of the construction and to the arrangements of the components set forth in the following description or illustrated in the drawings. Rather, the invention is capable of other embodiments and of being practiced and carried out in various other ways not specifically enumerated herein. Finally, it should be understood that the phraseology and terminology employed herein are for the purpose of description and should not be regarded as limiting, unless the specification specifically so limits the invention.

BRIEF DESCRIPTION OF THE DRAWINGS

These and further aspects of the invention are described in detail in the following examples and accompanying drawings.

FIGS. 2A-2D contain representations of some different sample types: FIG. 2A (sample 001) contains a sample of a lightweight woven square with freeform spiral stitching; FIG. 2B (sample 002) contains a representation of Jersey knit squares with freeform spiral stitching; FIG. 2C (sample 003) contains an example of Jersey knit strips stitched freeform in a grid approximately ½ in. (2 layers alternating); and, FIG. 2D (sample 004) contains denim (woven twill) strips stitched freeform grid approximately ½ in. (2 layers alternating).

FIG. 5 contains a blouse and a skirt manufactured according to an embodiment.

FIG. 6 contains a detailed view of the left shoulder of the embodiment of FIG. 5.

FIG. 7 contains a detailed view of the skirt of FIG. 5 in combination with a different blouse that has a fringe on its lower terminus.

DETAILED DESCRIPTION

Figure 1:
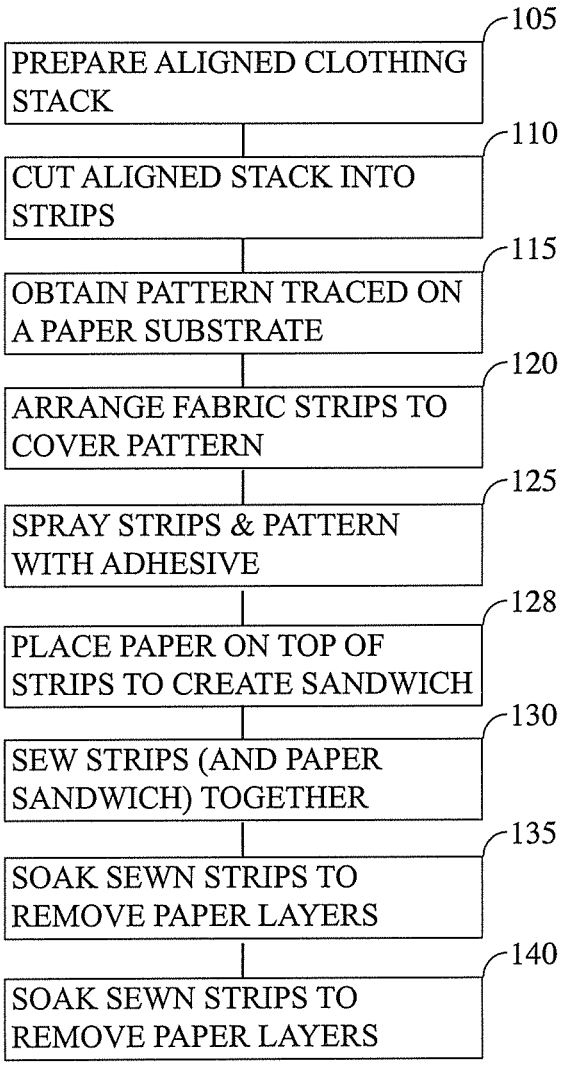
FIG. 1 illustrates an operating logic suitable for use with an embodiment.

While this invention is susceptible of embodiment in many different forms, there is shown in the drawings, and will herein be described hereinafter in detail, some specific embodiments of the instant invention. It should be understood, however, that the present disclosure is to be considered an exemplification of the principles of the invention and is not intended to limit the invention to the specific embodiments or algorithms so described.

An embodiment of the Re-CLÉM's process taught herein will allow upcycling to become as accepted and as easy as fiber reusing. The Re-CLÉM technology is transformative and can change the way people think about designing, manufacturing, and reusing clothing items that could otherwise be destined for the landfill.

Re-CLÉM in various embodiments overcomes many current apparel design sustainability challenges and differs from what others are doing and how others are experimenting. This mass production for the upcycling of textile products uses machinery others are not employing including, as a specific example, the long-arm quilting machine.

Various embodiments taught herein method a standardized system to be created; instead of spending time on creating a very expensive one-time garment, the same garment can be created in multiple sizes and color ways, lowering the cost of the upcycled clothing. Being able to do this is unique to Re-CLÉM, as others who upcycle struggle to reproduce styles.

Mass producing styles and fabric from recycling fibers is possible but often requires specific fiber contents or chemicals. Various embodiments do not use chemical processing because it can emit hazardous toxics into the environment. Further, the Re-CLÉM embodiments can be used on any fiber content.

Figure 3:
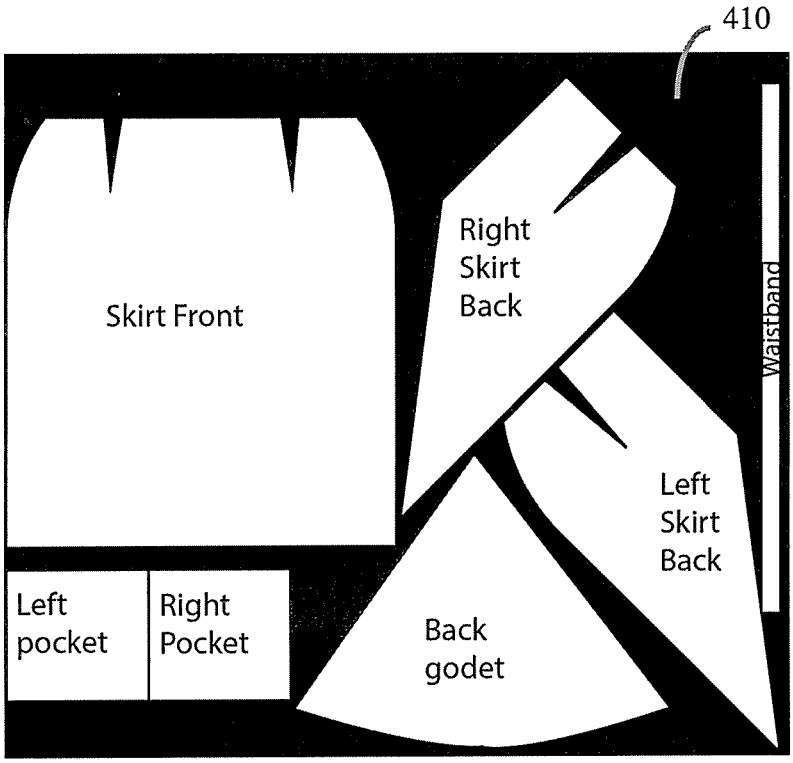
Fig. 3 (Prior art)
FIG. 3 shows a prior art approach to garment cutting for assembly, where the white regions represent the pattern pieces that are placed on a dark fabric. All visible dark regions in this figure represent fabric waste.

According to certain embodiments of the Re-CLÉM's process, no cutting waste occurs and there can be near 100% material utilization. Prior art approaches, such as the one illustrated in FIG. 3, manufacture clothing by laying out garment pattern elements on fabric. Even when best efforts are made to arrangement the pattern pieces on the fabric as much as 10% to 20% of the fabric from which is garment is made is wasted.

Figure 4:
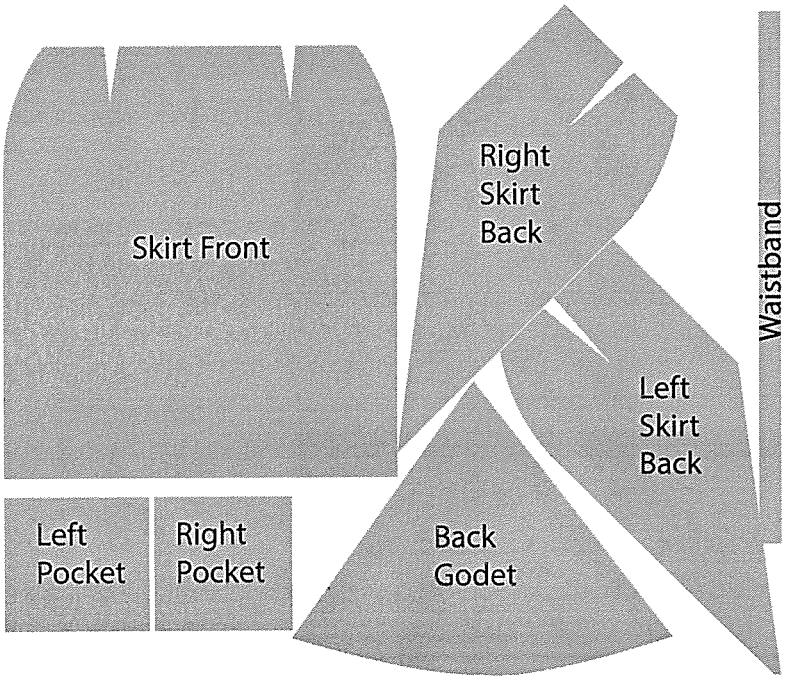
FIG. 4 contains an embodiment in which the same pattern pieces of FIG. 3 have been covered with fabric strips as described below, with no fabric in the white areas, resulting in zero waste.

By comparison, FIG. 4 contains an example of an embodiment which has resulted in essentially zero waste fabric. In this figure, the pattern pieces of FIG. 3 have been each been completely filled with pieces of cloth as described below and are ready to be assembled into a completed garment.

Recycling fibers, whether through mechanical or chemical processes, turns the fibers into fabric yardage through a variety of fabrication methods, including weaving and knitting. However, by creating a fabric, according to conventional approaches pattern pieces must still be cut which generates more waste. Various Re-CLÉM embodiments do not degrade fibers and any fiber content can be used.

Embodiments taught herein can be streamlined by those of ordinary skill in the art to fit into already established companies using a variety of fiber content and fabrications.

In addition, through the use of embodiments taught herein it will be possible to change the rules of designing and manufacturing in these four key areas: engineered grainlines, textile design within the pattern piece, reduce the number of seams, design the surface pattern within the body of the garment. Instead of being limited to the grainlines and prints of woven and knit yardage, the Re-CLÉM design process enables designers to create purposeful grain alignment while designing the surface pattern. This allows the designer to engineer into the apparel pattern the manner in which the garment hangs on the body and to strategically place surface designs. With the Re-CLÉM method, several seams can be eliminated from typical garment construction because the surface pattern of the textile can change without cutting and sewing separate fabrics together. More precisely, because the grain can be engineered onto the fabric, certain assembly seams, such as the shoulder and side seams can be eliminated through pattern manipulation and the ability to change the textile design and fabrication simultaneously with the creation of the pattern.

Various embodiments allow more design freedom and standardization than other upcycling processes. By rendering upcycled garments mass producible, the Re-CLÉM method processes the potential to affect the fashion industry in a large enough way to make a lasting positive impact on the environment. Table 1 below compares steps in the traditional garment development and production process to the Re-CLÉM process. Re-CLÉM also has added steps that do not have comparison in the traditional process. Table 1 below contains a high-level comparison between one embodiment of the approach taught herein and the prior art.

TABLE 1

Garment development and production process: comparison of traditional to an embodiment of the Re-CLÉM process.

| Stage | Traditional Process | Re-CLÉM's Process |
|---|---|---|
| Design | Design limited to yardage fabrication and typical grain alignment | Design with freedom from fabrication and grain alignment restrictions. |
| Sourcing | Purchase fabric by yard or bolt in desired color and prints. | Receive donations of unwanted garments. Cut into strips or squares, creating recycled fabric (RF) |
| Pattern Development | Separate pattern pieces created for each textile or design element used | One pattern piece created and design elements engineered into the layout of the RF. |

TABLE 1-continued

| | Garment development and production process: comparison of traditional to an embodiment of the Re-CLÉM process. | |
|---|---|---|
| Stage | Traditional Process | Re-CLÉM's Process |
| Getting textile into pattern piece shape | Cut pattern piece out in desired fabric(s) (generating cut waste) | Lay down the RF within the pattern shape, generating minimal or zero waste, on dissolvable material |
| Automated Sewing | | Sew within garment shape using automated long-arm sewing machine. |
| Finishing | | Washing, Drying, Blocking. |
| Manual labor Sewing | Construct garment, assembling many seams. (i.e. shoulder seams, side seams, design seams, etc.) | Construct garment with fewer steps (shoulder seams, design seams, etc., can be eliminated in the pattern stage) |
| Finishing | Cutting loose threads, quality control, final pressing | Cutting loose threads, quality control, final pressing |

Turning now to FIG. 1 which contains an operating logic suitable for an embodiment, as an initial step a stack of aligned cloth will be prepared 105. In some cases this might be a stack of identical garment types, (e.g., t-shirts, pants, etc.) of similar sizes that form the stack. In other cases, the clothing items in the stack might be of different types but trimmed so that the resulting stack is relatively uniform in shape. In some cases the stack might be about 5" tall, but the stack might be shorter or higher depending on the particular needs of the user. Of course, there is no requirement that the stack be precisely aligned, at least initially, and as long as the periphery of the stack can be trimmed to provide a stack that can be used according to the description that follows. Of course, in some cases the clothing might include or consist of fabric pieces which have not been formed into clothing. For example, pieces left over from the conventional manufacturing of clothing might be accumulated and trimmed and formed into an aligned stack, thereby reducing manufacturing waste.

Next, the aligned stack will be cut into strips 110 or some other fabric element shape. For purposes of clarity in the instant disclosure, the word "strips" will be used to describe the fabric pieces that are obtained from the fabric stack. However, that term should be understood to be just an example of the shape of fabric pieces that could be obtained in step 110.

Figure 9:
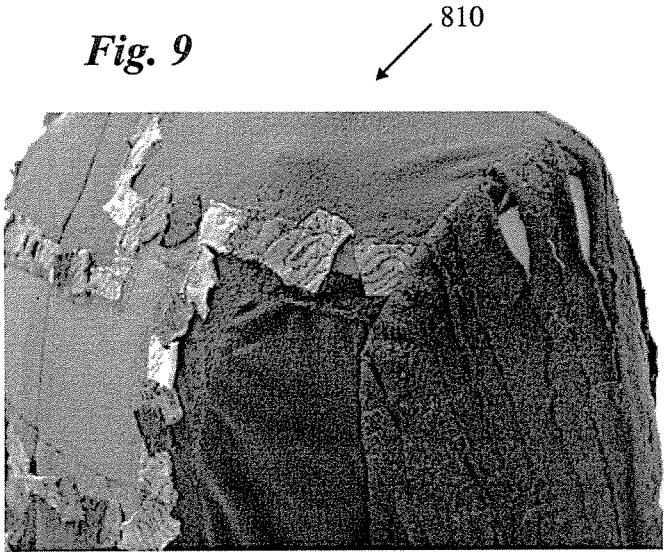
FIG. 9 contains a detailed view of the blouse embodiment of FIG. 9 which makes it clearer that the fabric pieces that are utilized are different sizes and shapes.
Figure 8:
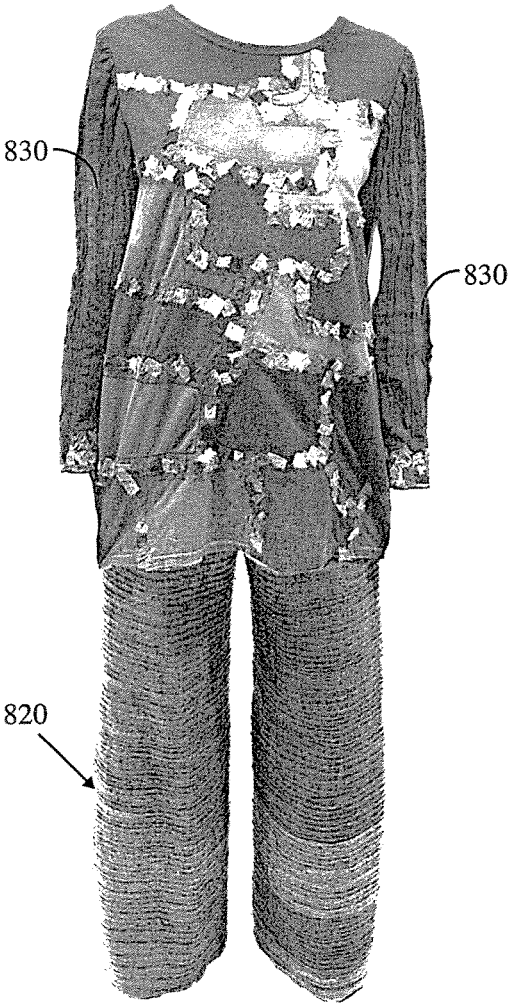
FIG. 8 contains a blouse and slacks manufactured according to an embodiment.

For example, in some cases, squares (or rectangles, triangles, etc.) of fabric might be cut instead of strips. FIGS. 8 and 9 contain an example of a garment that is created according to an embodiment which does not use strips of fabric but instead uses generally rectangular fabric patches. Those of ordinary skill in the art will readily be able to devise other shapes that would be suitable for use in creating an article of clothing.

Additionally, in some embodiments (e.g., if t-shirts or some other tubular fabrics are being upcycled) the garment might be cut to produce a continuous strand t-shirt yarn according to methods well known to those of skill in the art. The t-shirt yarn could then be accumulated using a yarn winder or some other similar product for use in an automated process. Note that for purposes of the instant disclosure "fabric elements" will be used to refer to the fabric pieces that are created by the cutting process whatever the cutting method or their shape might be.

The stacks of fabric might be rolled, twisted, or otherwise manipulated before cutting in some embodiments. In some instances, a circular cutting machine, laser, etc., will be used to perform the cuts. Obviously, the ability to cut regular strips will depend on the type of material, the particular cutting method and, in some cases, the height of the stack. In some embodiments, the strips will be parallel and about ¼" apart but, clearly, that is a design choice that is well within the ability of one of ordinary skill in the art to make and could depend on factors such as the fabric type, the desired aesthetic effect, etc. In some embodiments, a variety of different widths might be employed, rather than one constant width.

Next, according to one embodiment a pattern will be traced or otherwise transferred to a paper substrate (box 115) which might contain a representation of the pattern pieces. In some embodiments, rather than being on tissue paper the pattern pieces will be traced onto a more substantial/heavier weight paper substrate (e.g., a heavy weight paper that will serve to hold the garment together while it is being assembled). That being said, if the process has been automated the pattern could exist in digital form as positioning and cutting commands in the computer so there would be no need for a physical drawing. However, a plain paper substrate would still prove to be useful as described below. In the application that follows, when it is said that a pattern is created, formed, prepared, accessed, obtained, used, or traced, etc., that terminology should be broadly construed to include instances where the garment pattern is reproduced on a paper substrate of any weight and/or is stored as instructions in computer storage for use in an automated process. In the latter case the fabric elements could be placed on a plain paper substrate which does not contain a printed version of the pattern.

Note also that most clothing patterns have multiple components (e.g., a sleeve component, a body component, etc.) and, thus, when the word "pattern" is used herein that term should be understood to mean either a component of the pattern or the entire pattern depending on the particular pattern and the needs of the user. When the pattern is comprised of multiple pieces, each component could be handled separately or they could be all covered with fabric at the same time. In either case, it should be understood that when the pattern is comprised of multiple pattern pieces, after treatment as discussed below the pieces will need to be assembled into a garment as is done with conventional clothing patterns.

The fabric strips (to include other shapes) will then be placed on the paper within the boundaries of the outline of the pattern, thereby completely covering the pattern outline with the fabric strips (box 120 and FIG. 4). Note that when the term "cover" is used herein, that term should be construed to mean that the fabric strips completely fill the interior of the pattern outline (except where there are designed voids in the pattern, e.g., for arm holes or for design/style details, such as a lace or netting effect) and do not extend beyond it except incidentally due to, for example, manufacturing tolerances or to create fringe or other edge details. In those instances where edge details are desired, the interior of the pattern must still be covered by the fabric pieces. In some cases, the fabric strips may need to be cut (e.g., shortened) so that they conform to and fill the outline of the pattern. Thus, when it is said herein that the strips are arranged, positioned, etc., to cover a pattern or a pattern piece/component it should be understood that it may be necessary in some cases to cut a fabric strip so that it does not extend beyond the outline of the pattern before (or as) it is positioned within the outline.

The application of the fabric strips to the paper might be done manually or automatically. If it is done automatically, some embodiments will utilize a continuously fed length of cut fabric strips that are placed within the pattern outline and cut by, for example, a robotic arm and cutter combination.

Additionally, it has proven to be useful in some cases to use melt-away adhesive or stitch-and-dissolve material of the sort used in embroidery instead of paper as the substrate on which the fabric pieces are assembled.

Further, it has proven to be useful in some cases to spray an adhesive on the paper substrate so that as the fabric pieces are laid down they will remain in place during subsequent steps. The fabric strips that have been laid down and configured to conform to and completely cover the pattern will then be sprayed with an adhesive (box 125). Preferably the adhesive will be at least somewhat soluble in water or some other liquid so that it can easily be removed as discussed below.

In some embodiments, another sheet of paper will be placed atop the strips/pattern to create a "sandwich" of the fabric strips between the two paper sheets (box 128). The top sheet may also be adhered to the fabric strips in order to help immobilize them during the next step. In some cases the paper used in the sandwich might be a cellulose product which is at least somewhat water soluble.

The strips will be sewn together within the pattern area using, for example, a long-arm quilting machine or a similar device (box 130). In some embodiments the stitches will be in the form of parallel lines that are spaced less than about ½" apart (e.g., where the strips are about ¼" in width), although the particular spacing is not critical and can be adapted to suit the material and fabric strips that are used. In other embodiments, a freeform spiral or grid stitch might be used. In some cases, combinations of any of the foregoing (e.g., strip and grid stitch) could also be used. Of course, the stitch pattern could be cross hatched or otherwise organized and any so long as the fabric strips are securely sewn together to create a unified garment or garment component. The stitches themselves might be chosen to form a pattern and/or be decorative (e.g., FIG. 6, stitches 610). What is important is that the stitches include each of the strips within the pattern and bind them together so that when the adhesive and paper are removed a garment piece that conforms to the pattern is produced. It might be expected that some shapes of cut fabric will respond more favorably to some sewing patterns than others and those of ordinary skill in the art will readily be able to select a sewing pattern in a particular circumstance.

Next, the sewn fabric/paper sandwich will be placed in a bath to separate the paper from the cloth that it is adhered to (box 135). A water bath would be one possible way to soak the paper so that it can be removed from the sewn cloth strips. In some cases, the water bath might have soap added to it. Optionally the paper that is removed may be reclaimed from the bath and formed into paper labels for the garments or recycled and used in some other fashion. Although water is the preferred substance for removing the adhesive, other liquids might also be used, with the understanding that whatever solvent is used it should not harm the fabric or the thread used in the stitches.

After the garment pattern (or pieces thereof) have been separated from the paper sandwich, they can be assembled into a completed garment (box 135).

Textile Testing of New Fabrics.

In order to determine the performance characteristics of the textile yielded from an embodiment of the Re-CLÉM process, tests were conducted in a textile testing lab using tests compliant with AATCC and ASTM International standards. Absorbency, abrasion, pilling, wrinkle recovery, and tensile strength tests were conducted using four standard techniques and fiber contents. Samples tested were configured employing ½" textile squares and lightweight woven squares and ½" textile strips, and diverse longarm sewing machine stitching methods.

Results:

For the water repellency spray test, all four samples were tested three times, each test adhering to AATCC test method 22 standards. This Re-CLÉM method did not seem to change inherent properties associated with fabrication and fiber content. Sample 001 (lightweight woven squares, FIG. 2A) is made of lightweight manufactured fibers. All had a spray test rating of 50, meaning that there was complete wetting of the entire specimen face beyond the spray points. Due to their lightweight nature and content, this makes sense. Sample 002 (knit squares, FIG. 2B) is made of cotton knits. All specimens had a spray test rating of 0, meaning that there was complete wetting of the entire face and back of the specimen. The results did not change when using the same knit but in strip form (sample 003, FIG. 2C). Although sample 004 (strip denim, FIG. 2D) is thicker than the cotton knit samples, it behaved in the same manner (spray rating 0) as it is made of cotton. This test shows that the Re-CLÉM method does not disrupt typical repellency.

All four samples were tested with the ASTM D3884-09 standard using a Taber abrader rotary platform with double heads. The vacuum portion of this test was not used. This test shows that the Re-CLÉM method of small squares with random stitch is less resistant to abrasion than the strip method with grid stitching. The square embodiment was less abrasion resistant because holes were easily created between the squares. Results for the square method were recorded for when there was a surface change and how many revolutions it took to make a hole or a bigger hole. The strip method with grid stitching was more resistant to abrasion because the thread used broke before the strips were destroyed or holes were made. Due to this, results were recorded based off how many revolutions it took for the strip edge to curl up and then for the thread to break. Differences between the strip knit and strip denim is that the denim edges curled much quicker than the knit and the thread for the denim lasted longer although the same thread was used for both. This test method confirmed our hypothesis that the strip method was more resistant and stable than the square method. This testing also shows us that if we wanted to improve abrasion resistance for the squares then there needs to be more overlap and for the strips, thread strength should be increased.

All four samples were tested using the Altas Random tumble pilling tester following ASTM D3512/D3512M-10

(2014). The only modification made was that the apparatus for fabric evaluation was not utilized. However, all results were examined under the same light each time. Edges of specimens were not glued. The specimens were washed in a laundry machine before testing which still in yardage form, not after being cut to 4×4 in. Unfortunately, results of the pilling test were what we anticipated which was mostly extreme pilling. See figures below for unravel and fiber loss that occurred. Rating was done by either assigning a 1, 3, or 5 with 5 being covered in pills and 1 having almost none. Each sample had 3 specimens that were tested together for 30 minutes. Samples 001, 002, and 004 (FIGS. 2A, 2B, and 2D) all received average ratings of 5. Sample 003 (FIG. 2C) which was the knit strip did not pill nearly as much with average of 3.67. Ways to reduce this pilling and unraveling are being developed and will be tested and compared to these results.

All four samples were tested using the Thwing-Albert tensile machine adhering to grab tests outlined in ASTM D5034-09. Specimens were 4×8 inches. The jaw faces were 1×2 inches with a rubber face. Results show that sample 004 (denim strip) can withstand the most peak load of all samples tested. The strip and grid stitch method was stronger than the square and random stitch method withstanding higher peak loads. Sample 001 (woven squares. FIG. 2A) had the highest average peak elongation. More information needs to be gained on the meaning of collected data for peak tensile energy and breaking length in km.

All four samples were tested using AATCC TM128-201 to determine wrinkle recovery. Modifications made were that a viewing board was not used and that only one observer evaluated the specimen. The observer was not "trained". However, the specimens were evaluated in the same location under the same light. Samples 001 and 002 (FIGS. 2A and 2B) had moderate wrinkle recovery with wrinkles lessening some after 24 hours. Sample 003 (FIG. 2C) had great wrinkle recovery most likely due to it being made from knit. Sample 004 (FIG. 2D) had no wrinkle recovery and was covered in wrinkles after 24 hours. These results could be influenced by the thickness of the Re-CLÉM method but did not seem to be changed due to the stitching or layout.

Embodiments of the methods taught herein represent a significant step forward in the upcycling art. Key characteristics of various embodiments include: upcycles discarded clothing, employs minimal or zero waste, enables engineering of the surface design and design details into the garment piece, reduces the number of seams necessary for construction, is scalable for mass production, and resulting fabric serviceability meets industry standards.

Turning next to FIGS. 5, 6, and 7, these figures contain, respectively, a blouse and skirt produced according to an embodiment. In FIG. 5, the solid portions 510 of the design were formed as described above using strips of fabric, as were the cross hatched regions 520, eliminating the need to form them separately and sew them together, as would have been necessary in traditional garment manufacturing. The entire garment was then sewn and finished according to methods well known to those of ordinary skill in the art. FIG. 6 contains a detailed view of the model's left shoulder. As discussed previously, the decorative stitches 610 that hold the strips together can be more easily seen. FIG. 7 contains a detailed image of a portion the skirt of FIG. 5 which illustrates more clearly the strips of cloth that have been sewn together to form it. The image of FIG. 7 was created with a different blouse 710 that has as fringe component 720 on its lower terminus.

Figure 10:
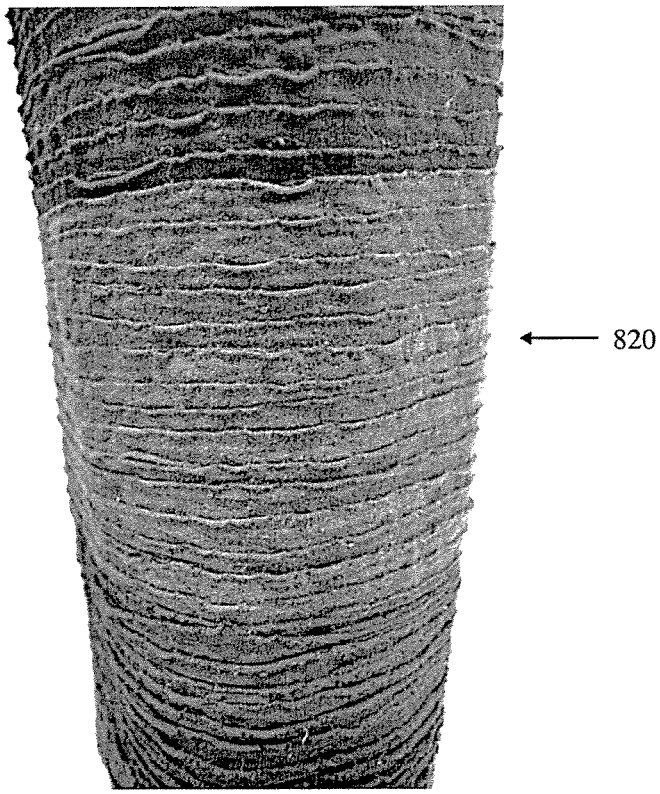
FIG. 10 contains a detailed view of a portion of the slacks embodiment of FIG. 8.

FIG. 8 contains a blouse 810 and slacks 820 prepared according to an embodiment. FIG. 9 contains an expanded view of a portion of the blouse 810 which makes clearer the patchwork-type approached used in the embodiment. The sleeves 830 in this case are formed from longitudinally extending strips of fabric. FIG. 10 contains an expanded view of a portion of the slacks 820 of FIG. 8. In this figure it is clearer that the slacks 820 have been constructed from horizontally aligned strips of fabric that have been sewn together as described above.

It is to be understood that the terms "including", "comprising", "consisting" and grammatical variants thereof do not preclude the addition of one or more components, features, steps, or integers or groups thereof and that the terms are to be construed as specifying components, features, steps or integers.

If the specification or claims refer to "an additional" element, that does not preclude there being more than one of the additional element.

It is to be understood that where the claims or specification refer to "a" or "an" element, such reference is not be construed that there is only one of that element.

It is to be understood that where the specification states that a component, feature, structure, or characteristic "may", "might", "can" or "could" be included, that particular component, feature, structure, or characteristic is not required to be included.

Where applicable, although state diagrams, flow diagrams or both may be used to describe embodiments, the invention is not limited to those diagrams or to the corresponding descriptions. For example, flow need not move through each illustrated box or state, or in exactly the same order as illustrated and described.

Methods of the present invention may be implemented by performing or completing manually, automatically, or a combination thereof, selected steps or tasks.

The term "method" may refer to manners, means, techniques and procedures for accomplishing a given task including, but not limited to, those manners, means, techniques and procedures either known to, or readily developed from known manners, means, techniques and procedures by practitioners of the art to which the invention belongs.

For purposes of the instant disclosure, the term "at least" followed by a number is used herein to denote the start of a range beginning with that number (which may be a ranger having an upper limit or no upper limit, depending on the variable being defined). For example, "at least 1" means 1 or more than 1. The term "at most" followed by a number is used herein to denote the end of a range ending with that number (which may be a range having 1 or 0 as its lower limit, or a range having no lower limit, depending upon the variable being defined). For example, "at most 4" means 4 or less than 4, and "at most 40%" means 40% or less than 40%. Terms of approximation (e.g., "about", "substantially", "approximately", etc.) should be interpreted according to their ordinary and customary meanings as used in the associated art unless indicated otherwise. Absent a specific definition and absent ordinary and customary usage in the associated art, such terms should be interpreted to be ±10% of the base value.

When, in this document, a range is given as "(a first number) to (a second number)" or "(a first number)–(a second number)", this means a range whose lower limit is the first number and whose upper limit is the second number. For example, 25 to 100 should be interpreted to mean a range whose lower limit is 25 and whose upper limit is 100. Additionally, it should be noted that where a range is given, every possible subrange or interval within that range is also specifically intended unless the context indicates to the contrary. For example, if the specification indicates a range of 25 to 100 such range is also intended to include subranges such as 26-100, 27-100, etc., 25-99, 25-98, etc., as well as any other possible combination of lower and upper values within the stated range, e.g., 33-47, 60-97, 41-45, 28-96, etc. Note that integer range values have been used in this paragraph for purposes of illustration only and decimal and fractional values (e.g., 46.7-91.3) should also be understood to be intended as possible subrange endpoints unless specifically excluded.

It should be noted that where reference is made herein to a method comprising two or more defined steps, the defined steps can be carried out in any order or simultaneously (except where context excludes that possibility), and the method can also include one or more other steps which are carried out before any of the defined steps, between two of the defined steps, or after all of the defined steps (except where context excludes that possibility).

Further, it should be noted that terms of approximation (e.g., "about", "substantially", "approximately", etc.) are to be interpreted according to their ordinary and customary meanings as used in the associated art unless indicated otherwise herein. Absent a specific definition within this disclosure, and absent ordinary and customary usage in the associated art, such terms should be interpreted to be plus or minus 10% of the base value.

Still further, additional aspects of the instant invention may be found in one or more appendices attached hereto and/or filed herewith, the disclosures of which are incorporated herein by reference as if fully set out at this point.

Thus, the present invention is well adapted to carry out the objects and attain the ends and advantages mentioned above as well as those inherent therein. While the inventive device has been described and illustrated herein by reference to certain preferred embodiments in relation to the drawings attached thereto, various changes and further modifications, apart from those shown or suggested herein, may be made therein by those of ordinary skill in the art, without departing from the spirit of the inventive concept the scope of which is to be determined by the following claims.

What is claimed is:

1. A method of upcycling a plurality of cloth articles to form a garment, comprising the steps of:

a. accessing an aligned stack formed from said plurality of cloth articles;

b. making a plurality of cuts into said aligned stack, thereby producing a plurality of fabric elements;

c. obtaining a garment pattern, said garment pattern being comprised of one or more pattern pieces, each of said plurality of pattern piece having an outline associated therewith;

d. selecting one of said at least one pattern pieces;

e. positioning some or all of said fabric elements within an outline associated with said selected pattern piece in such a way as to completely cover said pattern piece outline associated with said selected pattern piece without extending beyond it, thereby creating a fabric layer;

f. applying a water-soluble adhesive to said fabric layer;

g. applying a paper layer to a top of said fabric layer, thereby adhering said paper layer to said fabric layer;

h. stitching said paper layer and said fabric layer together, thereby forming a unified pattern piece sandwich;

i. soaking said pattern piece sandwich in water for a period of time sufficient to separate said paper layer and said fabric layer, and sufficient to dissolve said adhesive;

j. performing steps (d) through (i) for each of said at least one or more paper components, thereby producing at least one separated fabric layer; and, k. using said at least one separated fabric layers to form said garment.

2. The method of claim 1, wherein step (e) comprises the step of:

(e1) positioning some or all of said fabric elements within said outline of said selected one of said at least one pattern piece on a substrate in such a way as to completely cover said pattern piece outline without extending beyond it, thereby creating a fabric layer, and, wherein step (h) comprises the step of (h1) stitching said paper layer, said fabric layer together, and said substrate together thereby forming a unified pattern piece sandwich, and, wherein step (i) comprises the step of:

(i1) soaking said pattern piece sandwich in water for a period of time sufficient to separate said paper layer and said substrate from said fabric layer, and sufficient to dissolve said adhesive.

3. The method of claim 2, wherein said garment pattern is a paper pattern and wherein said substrate comprises said garment pattern.

4. The method of claim 2, wherein said substrate comprises a stitch-and-dissolve material.

5. The method of claim 1, wherein said plurality of cuts comprise a plurality of parallel cuts.

6. The method of claim 1, wherein said plurality of clothing articles comprises a plurality of t-shirts.

7. A method of upcycling a plurality of clothing articles to form a garment, comprising the steps of:

a. forming said plurality of clothing articles into an aligned stack;

b. making a plurality of cuts into said stack, thereby producing a plurality of fabric elements;

c. obtaining a garment pattern, said garment pattern being comprised of one or more pattern pieces, each of said one or more pattern pieces having an outline associated therewith;

d. selecting one of said one or more pattern pieces;

e. positioning some or all of said fabric elements on a substrate within an outline associated with said selected pattern piece in such a way as to completely cover said selected pattern piece outline without extending beyond it, thereby creating a fabric layer on said substrate;

f. applying an adhesive to a top of said fabric layer;

g. placing a paper layer on said top of said fabric, thereby adhering it thereto;

h. stitching the paper layer, the fabric layer, and the substrate together, thereby forming a unified pattern piece sandwich;

i. soaking said unified pattern piece sandwich for a period of time sufficient to dissolve said adhesive and to separate the paper layer and the substrate from said fabric layer;

j. performing steps (d) through (i) for each of said at least one or more pattern pieces, thereby producing at least one separated fabric layer; and, k. using said at least one separated fabric layer to form the garment.

8. The method of claim 7, wherein said garment pattern is a paper garment pattern and said paper garment pattern comprises said substrate.

9. The method of claim 7, wherein said plurality of cuts comprise a plurality of parallel cuts.

10. The method of claim 7, wherein said garment pattern is a garment pattern made from a stitch-and-dissolve material and said garment pattern comprises said substrate.

11. A method of upcycling a plurality of cloth articles to form a garment, comprising the steps of:

a. forming said plurality of cloth articles into an aligned stack;

b. making a plurality of cuts into said aligned stack, thereby producing a plurality of fabric elements;

c. obtaining a garment pattern, said garment pattern being comprised of one or more pattern pieces, each of said one or more pattern pieces having an outline associated therewith;

d. selecting one of said at least one pattern pieces;

e. positioning some or all of said fabric elements within an associated outline of said selected one of said at least one pattern piece in such a way as to completely cover said associated pattern piece outline, thereby creating a fabric layer;

f. applying an adhesive to said fabric layer;

g. applying a paper layer to a top of said fabric layer;

h. stitching said paper layer and said fabric layer together, thereby forming a unified garment component sandwich;

i. soaking said unified garment component sandwich for a period of time sufficient to separate the paper layer from said fabric layer, and sufficient to dissolve said adhesive;

j. performing steps (d) through (i) for each of said at least one or more garment components, thereby producing at least one separated fabric layer; and, k. using said at least one separated fabric layer to form the garment.

12. The method of claim 11, wherein at least a portion of said fabric elements extends beyond said garment pattern to create an edge detail.

13. The method of claim 12, wherein said edge detail is a fringe.

* * * * *